US005462851A

United States Patent [19]

Kato et al.

[11] Patent Number: 5,462,851

[45] Date of Patent: Oct. 31, 1995

[54] SILVER HALIDE PHOTOGRAPHIC MATERIAL

[75] Inventors: Takashi Kato; Tadashi Ikeda, both of Kanagawa, Japan

[73] Assignee: Fuji Photo Film Co., Ltd., Kanagawa, Japan

[21] Appl. No.: 121,740

[22] Filed: Sep. 16, 1993

[30] Foreign Application Priority Data

Sep. 24, 1992 [JP] Japan ..... 4-254565

[51] Int. Cl.[6] ..... G03C 1/20

[52] U.S. Cl. ..... 430/584; 430/582; 430/583; 430/592; 430/578

[58] Field of Search ..... 430/584, 583, 430/588, 592, 582, 578

[56] References Cited

U.S. PATENT DOCUMENTS

| | | | |
|---|---|---|---|
| 3,734,739 | 5/1973 | Borror | 430/588 |
| 5,037,733 | 8/1991 | Goda | 430/584 |

OTHER PUBLICATIONS

The Theory of the Photographic Process, Fourth Edition, T. H. James (1989), pp. 216–217.

*Primary Examiner*—Thorl Chea

*Attorney, Agent, or Firm*—Sughrue, Mion, Zinn, Macpeak & Seas

[57] ABSTRACT

A silver halide photographic material is disclosed which contains at least one methine dye represented by the following formula (I) or (II):

(I)

(II)

wherein $Z_1$ and $Z_2$ each represents an atomic group for forming a five-membered or six-membered nitrogen-containing heterocyclic ring; $R_1$, $R_2$, $R_4$ and $R_5$ each represents an alkyl group; $R_3$ and $R_6$ each represents an alkyl group, an aryl group or a heterocyclic group; $V_1$ to $V_{12}$ each represents a hydrogen atom or a substituent; $L_1$ to $L_{10}$ each represents a methine group; $M_1$ and $M_2$ each represents an ion for neutralizing charge; $m_1$ and $m_2$ each represents a number of 0 or more which is required for neutralizing charge; and $n_1$ and $n_2$ each represents 0 or 1.

10 Claims, No Drawings

SILVER HALIDE PHOTOGRAPHIC MATERIAL

FIELD OF THE INVENTION

This invention relates to a methine compound and a silver halide photographic material containing the same. More particularly, it relates to a cyanine dye having a crosslinked structure within the methine chain thereof and a quinoline nucleus bonded to the methine chain at the 2-position of the quinoline nucleus and to a silver halide photographic material containing the cyanine dye.

BACKGROUND OF THE INVENTION

Recording materials sensitized to the infrared region, for example, recording materials for recording the output of near infrared beams, have been proposed in recent years. For example, there is known an image forming method using a scanner system wherein the original is scanned, and a silver halide photographic material is exposed to light on the basis of the resulting image signals to form a negative image or a positive image corresponding to the image of the original in this method, a semiconductor laser is most preferably used as the light source for recording in the scanner system. The semiconductor laser is small-sized and inexpensive, can be easily modulated, and has a working life which is longer than that of an He-Ne laser, argon laser, etc. Since the semiconductor laser emits light in the infrared region, the semiconductor laser has the further advantage that when infrared sensitive photographic materials are used, light safelight can be used and hence handleability and workability can be improved.

However, the oscillating wavelengths of the semiconductor are in the infrared region, and hence photographic materials having high light sensitivity in the infrared region are required.

Since sensitizing dyes having spectral sensitivity in the infrared region usually have a molecular band type wide absorption band, the dependence of sensitivity on the wavelengths is generally small. Accordingly, when the photographic materials are composed of a plurality of light-sensitive layers, it is difficult for individual light-sensitive layers to be selectively exposed to different laser beams. That is, color separation is deteriorated.

Accordingly, there has been a demand for a dye having sharp absorption in the infrared region.

The present inventors have studied near infrared J-band type dyes to develop dyes having sharp absorption in the infrared region. As a result, it has been found that when dicarbocyanine dyes having a specific methine chain crosslinked structure are used, J-associate in the silver halide emulsions can be formed in the infrared region, and a sharp absorption band can be obtained in the infrared region. The present-inventors have filed a patent application on the basis of this finding [see JP-A-4-146431 (the term "JP-A" as used herein means an "unexamined published Japanese patent application")].

However, there has still been a demand for dyes having sharp absorption according to various uses.

SUMMARY OF THE INVENTION

Accordingly, an object of the present invention is to provide a cyanine dye having sharp absorption in the infrared region.

Another object of the present invention is to provide a silver halide photographic material containing the above-described cyanine dye.

These and other objects of the present invention have been achieved by providing:

a silver halide photographic material comprising at least one compound represented by the following formula (I):

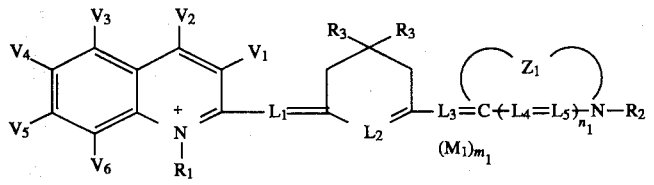

(I)

wherein $Z_1$ represents an atomic group required for forming a five-membered or six-membered nitrogen-containing heterocyclic group; $R_1$ and $R_2$ each represents an alkyl group; two $R_3$ groups represent an alkyl group, an aryl group or a heterocyclic group; $V_1$, $V_2$, $V_3$, $V_4$, $V_5$ and $V_6$ each represents a hydrogen atom or a substituent group; $L_1$, $L_2$, $L_3$, $L_4$ and $L_5$ each represents a methine group; $n_1$ represents 0 or 1; $M_1$ represents an ion for neutralizing charge; and $m_1$ represents a number of 0 or more which is required for neutralizing charge in the compound; and a silver halide photographic material comprising at least one compound represented by the following formula (II):

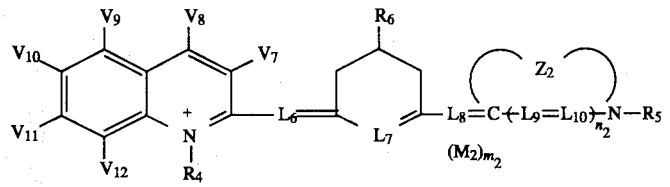

(II)

wherein $Z_2$ represents an atomic group required for forming a five-membered or six-membered nitrogen-containing heterocyclic group; $R_4$ and $R_5$ each represents an alkyl group; $R_6$ represents an alkyl group, an aryl group or a heterocyclic group; $V_7$, $V_8$, $V_9$, $V_{10}$, $V_{11}$ and $V_{12}$ each represents a hydrogen atom or a substituent group; $L_6$, $L_7$, $L_8$, $L_9$ and $L_{10}$ each represents a methine group; $n_2$ represents 0 or 1; $M_2$ represents an ion for neutralizing charge; and $m_2$ represents a number of 0 or more required for neutralizing charge in the compound.

DETAILED DESCRIPTION OF THE INVENTION

The present invention is described in more detail below.

The compounds of formula (I) and the compounds of formula (II) in combination may be contained in the photographic materials of the present invention. Further, the compounds of formula (I) and/or the compounds of formula (II) may be used together with other sensitizing dyes (particularly infrared sensitizing dyes).

The compounds of formulas (I) and (II) are novel compounds.

The compounds of formulas (I) and (II) will be illustrated in greater detail below.

Examples of the heterocyclic group formed by $Z_1$ or $Z_2$ include thiazole nuclei {for example, a thiazole nucleus (e.g., thiazole, 4-methylthiazole, 4-phenylthiazole, 4,5-dimethylthiazole, 4,5-diphenylthiazole), a benzthiazole nucleus (e.g., benzthiazole, 4-chlorobenzthiazole, 5-chlorobenzthiazole, 6-chlorobenzthiazole, 5-nitrobenzthiazole, 4-methylbenzthiazole, 5-methylbenzthiazole, 6-methylbenzthiazole, 5-bromobenzthiazole, 6-bromobenzthiazole, 5-iodobenzthiazole, 5-phenylbenzthiazole, 5-methoxybenzthiazole, 6-methoxybenzthiazole, 5-ethoxybenzthiazole, 5-ethoxycarbonylbenzthiazole, 5-carboxybenzthiazole, 5-phenethylbenzthiazole, 5-fluorobenzthiazole, 5-chloro-6-methylbenzthiazole, 5,6-dimethylbenzthiazole, 5,6-dimethoxybenzthiazole, 5-hydroxy-6-methylbenzthiazole, tetrahydrobenzthiazole, 4-phenylbenzthiazole, 5,6-bismethylthiobenzthiazole), a naphthothiazole nucleus (e.g., naphtho[2,1-d]thiazole, naphtho-[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole]}; thiazoline nuclei (for example, thiazoline, 4-methylthiazoline, 4-nitrothiazoline); oxazole nuclei {for example, an oxazole nucleus (e.g., oxazole, 4-methyloxazole, 4-nitrooxazole, 5-methyloxazole, 4-phenyloxazole, 4,5-diphenyloxazole, 4-ethyloxazole), a benzoxazole nucleus (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole), a naphthoxazole nucleus (e.g., naphtho[2,1-d]-oxazole, naphtho[1,2-d]oxazole, naphtho[2,3-d]oxazole, 5-nitronaphtho[2,1-d]oxazole)); oxazoline nuclei (for example, 4,4-dimethyloxazoline); selenazole nuclei {for example, a selenazole nucleus (e.g., 4-methylselenazole, 4-phenylselenazole), a benzoselenazole nucleus (e.g., benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, 5,6-dimethylbenzoselenazole), a naphthoselenazole nucleus (e.g., naphtho [2,1-d]selenazole, naphtho [1,2-d selenazole)}; selenazoline nuclei (for example selenazoline}4-methylselenazoline); and quinoline nuclei {for example, a quinoline nucleus (e.g., 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, 6-methyl-4-quinoline, 6-methoxy-5-quinoline, 6-chloro-4-quinoline).

Preferred as the heterocyclic group formed by $Z_1$ or $Z_2$ are benzthiazole, naphthothiazole, benzoxazole and naphthoxazole nuclei.

$R_3$ and $R_6$ are each an alkyl group having preferably from 1 to 18 carbon atoms {e.g., methyl, ethyl, propyl, isopropyl, allyl, butyl, isobutyl, hexyl, octyl, dodecyl, octadecyl and the alkyl group may be substituted [examples of substituent groups include a carboxyl group, a sulfo group, a cyano group, a nitro group, a halogen atom, a hydroxyl group, an alkoxy group having from 1 to 8 carbon atoms (e.g., methoxy, ethoxy, benzyloxy, phenethyloxy), an aryloxy group having from 6 to 15 carbon atoms (e.g., phenoxy), an acyloxy group having from 1 to 8 carbon atoms (e.g., acetyloxy), an acyl group having from 1 to 8 carbon atoms (e.g., acetyl), a sulfamoyl group (e.g., sulfamoyl, N,N-dimethylsulfamoyl, morpholinosulfonyl, piperidino-sulfonyl), a carbamoyl group (e.g., carbamoyl, N,N-dimethylcarbamoyl, morpholinocarbonyl, piperidinocarbonyl) and an aryl group having from 6 to 15 carbon atoms (e.g., phenyl, 4-methylphenyl, 4-chlorophenyl, α-naphthyl)]}; an aryl group having from 6 to 18 carbon atoms {e.g., phenyl, 2-naphthyl, 1-naphtyl and the aryl group may be substituted [examples of substituent groups include a carboxyl group, a sulfo group, a cyano group, a nitro group, a halogen atom, an alkyl group having from 1 to 8 carbon atoms (e.g., methyl, ethyl), an alkoxy group having from 1 to 8 carbon atoms (e.g., methoxy, ethoxy), an aryloxy group having from 6 to 15 carbon atoms (e.g., phenoxy), an acyloxy group having from 1 to 8 carbon atoms (e.g., acetyloxy), an acyl group having 1 to 8 carbon atoms (e.g., acetyl), a sulfamoyl group, a carbamoyl group and an aryl group having from 6 to 15 carbon atoms (e.g., phenyl)]}; or a heterocyclic group having from 3 to 18 carbon atoms {e.g., 2-pyridyl, 2-thiazoolyl, 2-furyl and the heterocyclic group may be substituted (examples of substituent groups are the same as the examples of substituent groups of substituted aryl groups defined above).}.

Preferred as $R_3$ and $R_6$ are an unsubstituted alkyl group (e.g., methyl, ethyl, propyl, butyl) or an unsubstituted aryl group (e.g., phenyl, 1-naphthyl). More preferred as $R_3$ and $R_6$ are methyl, ethyl and phenyl groups.

Preferred as the alkyl group represented by $R_1$, $R_2$, $R_4$ and $R_5$ are an unsubstituted alkyl group having from 1 to 18 carbon atoms (e.g., methyl, ethyl, propyl, butyl, pentyl, hexyl, heptyl, octyl, decyl, dodecyl, octadecyl) and a substituted alkyl group having from 1 to 18 carbon atoms {examples of substituent groups include a carboxyl group, a sulfo group, a cyano group, a halogen atom (e.g., fluorine, chlorine, bromine), a hydroxyl group, an alkoxycarbonyl group having from 2 to 8 carbon atoms (e.g., methoxycarbonyl, ethoxycarbonyl, phenoxycarbonyl benzyloxycarbonyl), an alkoxy group having from 1 to 8 carbon atoms (e.g., methoxy, ethoxy, benzyloxy, phenethyloxy), an aryloxy group having from 6 to 15 carbon atoms (e.g., phenoxy, p-tolyloxy, α-naphthoxy), an acyloxy group having from 1 to 8 carbon atoms (e.g., acetyloxy, propionyloxy), an acyl group having from 1 to 8 carbon atoms (e.g., acetyl, propionyl, benzoyl), a carbamoyl group (e.g., carbamoyl, N,N-dimethylcarbamoyl, morpholinocarbonyl, piperidinocarbonyl) a sulfamoyl group (e.g., sulfamoyl, N,N-dimethylsulfamoyl, morpholinosulfonyl, piperidinosulfonyl), and an aryl group having from 6 to 15 carbon atoms (e.g., phenyl, 4-chlorophenyl, 4-methylphenyl, α-naphthyl).

More preferred as $R_1$, $R_2$, $R_4$ and $R_5$ are an unsubstituted alkyl group (e.g., methyl, ethyl, propyl), an alkoxy group-substituted alkyl group (e.g., methoxyethyl) or a sulfoalkyl group (e.g., 2-sulfoethyl, 3-sulfopropyl, 4-sulfobutyl).

Preferred as $V_1$, $V_2$, $V_3$, $V_4$, $V_5$, $V_6$, $V_7$, $V_8$, $V_9$, $V_{10}$, $V_{11}$ and $V_{12}$ are a hydrogen atom, a halogen atom (e.g., fluorine, chlorine, bromine), an unsubstituted alkyl group having from 1 to 10 carbon atoms (e.g., methyl, ethyl), a substituted alkyl group having from 1 to 18 carbon atoms (e.g., benzyl, α-naphthylmethyl, 2-phenylethyl, trifluoromethyl), an acyl group having from 1 to 8 carbon atoms (e.g., acetyl, benzoyl), an acyloxy group having from 1 to 8 carbon atoms (e.g., acetyloxy), an alkoxycarbonyl group having from 2 to 8 carbon atoms (e.g., methoxycarbonyl, ethoxycarbonyl, benzyloxycarbonyl), a carbamoyl group (e.g., carbamoyl, N,N-dimethylcarbamoyl, morpholinocarbonyl, piperidinocarbonyl), a sulfamoyl group (e.g., sulfamoyl, N,N-dimethylsulfamoyl, morpholinosulfonyl, piperidinosulfonyl), a carboxyl group, a cyano group, a hydroxyl group, an amino group, an acylamino group having from 1 to 8 carbon atoms (e.g., acetylamino), an alkoxy group having from 1 to 10 carbon atoms (e.g., methoxy, ethoxy, benzyloxy), an alkylthio group having from 1 to 10 carbon atoms (e.g., ethylthio), an alkylsulfonyl group having from 1 to 5 carbon atoms (e.g., methylsulfonyl), a sulfonic acid group or an aryl group having from 6 to 15 carbon atoms (e.g., phenyl, tolyl). A hydrogen atom, an unsubstituted alkyl group (e.g., methyl) and an alkoxy group (e.g., methoxy) are more preferred as $V_1$ to $V_{12}$.

$L_1$, $L_2$, $L_3$, $L_4$, $L_5$, $L_6$, $L_7$, $L_8$, $L_9$ and $L_{10}$ each represents a methine group which may be substituted [examples of substituent groups include an alkyl group (e.g., methyl, ethyl, 2-carboxyethyl), an aryl group (e.g., phenyl), a halogen atom (e.g., chlorine atom), an alkoxy group (e.g., methoxy, ethoxy) and an amino group (e.g., N,N-diphenylamino, N-methyl-N-phenylamino, N-methylpiperazino)], or may be combined together with an other methine group or an auxochrome to form a ring. Preferred as $L_1$ to $L_{10}$ are an unsubstituted methine group and a methine group substituted by an alkyl group. Preferably, the alkyl group is substituted at the position of $L_2$ or $L_{10}$.

$M_1$, $M_2$, $m_1$ and $m_2$ are included in the formulas to show the presence or absence of a cation or an anion when the ionic charge of the dye is to be neutralized. Whether a dye is a cation or an anion or has no net ionic charge varies depending on the type of the auxochrome and the substituent groups.

Typical examples of the cation include ammonium ions and alkali metal ions. The anion may be any of inorganic anions and organic anions. Examples of the anion include a halide ion (e.g., fluorine ion, chloride ion, bromide ion, iodide ion), a substituted arylsulfonate ion (e.g., p-toluenesulfonate ion, p-chlorobenzenesulfonate ion), an aryldisulfonate ion (e.g., 1,3-benzenedisulfonate ion, 1,5-naphthalenedisulfonate ion, 2,6-naphthalenedisulfonate ion), an alkylsulfate ion (e.g., methylsulfate ion), a sulfate ion, a thiocyanate ion, a perchlorate ion, a tetrafluoroborate ion, a picrate ion, an acetate ion and a trifluoromethanesulfonate ion. $M_1$ and $M_2$ each may be an ion for neutralizing two or more ionic charges.

Specific examples of the cation which can be preferably used include sodium ion, potassium ion and triethylammonium ion. Specific examples of the anion which can be preferably used include perchlorate ion, iodide ion, bromide ion and a substituted arylsulfonate ion (e.g., p-toluenesulfonate ion).

Specific examples of the compounds of general formulas (I) and (II) which can be used in the present invention include, but are not limited to, the following compounds:

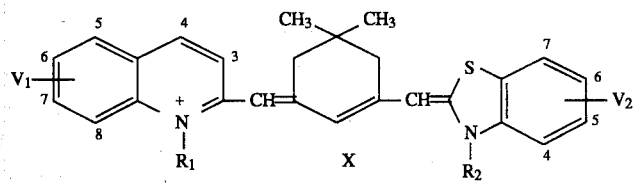

| No. | $R_1$ | $R_2$ | $V_1$ | $V_2$ | X |
|---|---|---|---|---|---|
| (I-1) | $-C_2H_5$ | $-C_2H_5$ | −H | −H | $ClO_4^-$ |
| (I-2) | $-(CH_2)_2SO_3^-$ | $-C_2H_5$ | −H | −H | — |
| (I-3) | $-(CH_2)_2SO_3^-$ | $-(CH_2)_4SO_3^-$ | 6-$CH_3$ | −H | $Na^+$ |
| (I-4) | $-(CH_2)_2OCH_3$ | $-CH_3$ | 6-Cl | −H | 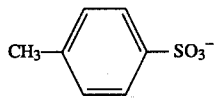 |
| (I-5) | $-CH_3$ | $-C_2H_5$ | −H | 4,5-benzo | $I^-$ |
| (I-6) | $-CH_3$ | $-CH_3$ | −H | 4,5-benzo | $I^-$ |
| (I-7) | $-C_2H_5$ | $-(CH_2)_2OCH_3$ | −H | 5-$OCH_3$ | $Br^-$ |
| (I-8) | $-(CH_2)_2COOH$ | $-(CH_2)_2COOH$ | −H | 5-Cl | $I^-$ |
| (I-9) | $-(CH_2)_2CH=CH_2$ | $-(CH_2)_3SO_3^-$ | 6-$OCH_3$ | 5,6-di-$CH_3$ | — |
| (I-10) | $-(CH_2)_3SO_3^-$ | $-(CH_2)_2CONHSO_2CH_3$ | −H | 5,6-di-$CH_3$ | — |
| (I-11) | $-(CH_2)_4SO_3^-$ | $-(CH_2)_4SO_3^-$ | 7-$CH_3$ | 6,7-benzo | $HN^+(C_2H_5)_3$ |
| (I-12) | $-CH_3$ | $-(CH_2)_2CONH(CH_2)_2SO_3^-$ | 7-Cl | 4-$OCH_3$ | — |

-continued
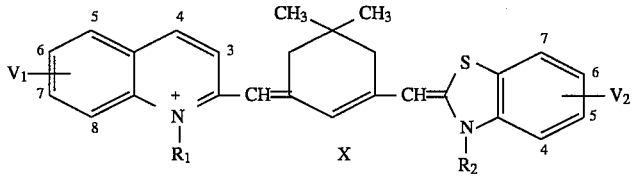
| No. | $R_1$ | $R_2$ | $V_1$ | $V_2$ | X |
|---|---|---|---|---|---|
| (I-13) | 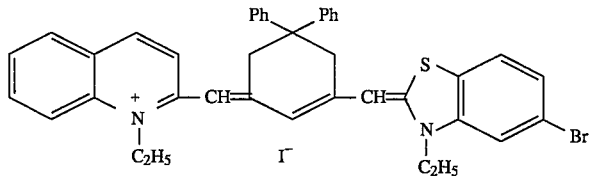 | | | | |
| (I-14) | 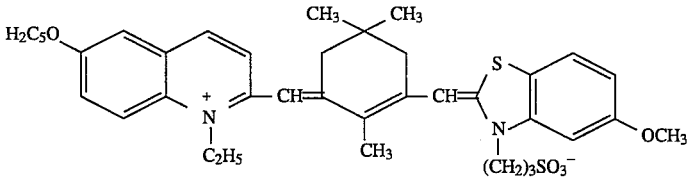 | | | | |
| (I-15) | 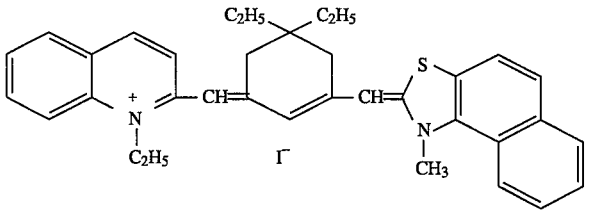 | | | | |
| (I-16) | 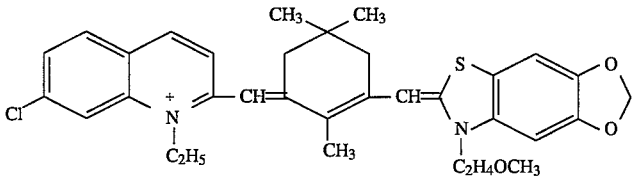 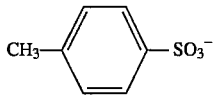 | | | | |
| (I-17) | 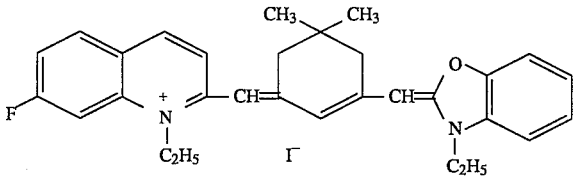 | | | | |
| (I-18) | 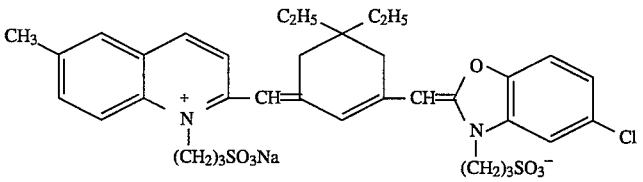 | | | | |

-continued

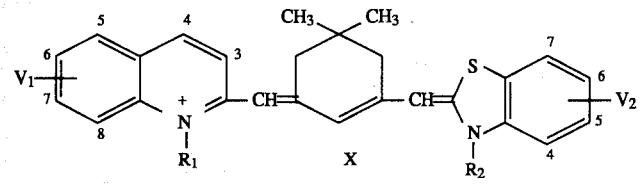

| No. | $R_1$ | $R_2$ | $V_1$ | $V_2$ | X |
|---|---|---|---|---|---|
| (I-19) | 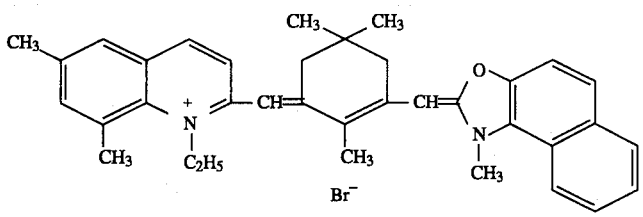 | | | | |
| (I-20) | 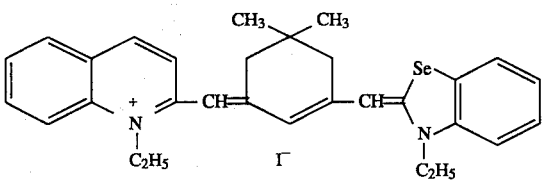 | | | | |

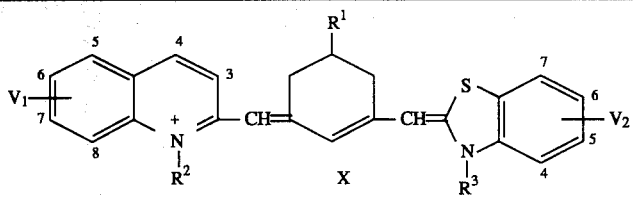

| No. | $R^1$ | $R^2$ | $R^3$ | $V_1$ | $V_2$ | X |
|---|---|---|---|---|---|---|
| (II-1) | $-CH_3$ | $-C_2H_5$ | $-C_2H_5$ | $-H$ | $-H$ | $Br^-$ |
| (II-2) | $-CH_3$ | $-(CH_2)_2SO_3^-$ | $-(CH_2)_3SO_3^-$ | 6-Cl | $-H$ | $Na^+$ |
| (II-3) | $-CH_3$ | $-(CH_2)_2OCH_3$ | $-(CH_2)_2OCH_3$ | 6-$OCH_3$ | 4-$OCH_3$ | $I^-$ |
| (II-4) | $-CH_3$ | $-(CH_2)_2COOH$ | $-(CH_2)_2COOH$ | 7-$CH_3$ | 5-Cl | $Br^-$ |
| (II-5) | $-CH_3$ | $-CH_3$ | $-(CH_2)_3SO_3^-$ | $-H$ | 5-$OCH_3$ | — |
| (II-6) | $-Ph$ | $-C_2H_5$ | $-C_2H_5$ | $-H$ | $-H$ | $ClO_4$ |
| (II-7) | $-Ph$ | $-(CH_2)_4SO_3^-$ | $-(CH_2)_3SO_3^-$ | $-H$ | 5,6-di-$CH_3$ | $Na^+$ |
| (II-8) | $-Ph$ | $-(CH_2)_2CONHSO_2CH_3$ | $-(CH_2)_3SO_3^-$ | 5,7-di-$CH_3$ | 4,5-benzo | — |
| (II-9) | $-Ph$ | $-CH_3$ | $-(CH_2)_3SO_3^-$ | $-H$ | 5-$OCH_3$ | — |
| (II-10) | $-C_2H_5$ | $-C_2H_5$ | $-C_2H_5$ | $-H$ | $-H$ | 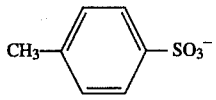 |
| (II-11) | 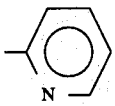 | $-C_2H_5$ | $-C_2H_5$ | $-H$ | $-H$ | $I^-$ |
| (II-12) | 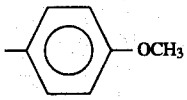 | $-C_2H_5$ | $-C_2H_5$ | 7-$OC_2H_5$ | $-H$ | $I^-$ |

-continued
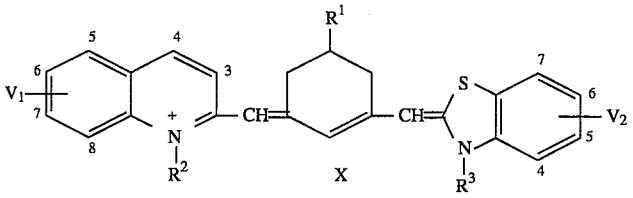
| No. | $R^1$ | $R^2$ | $R^3$ | $V_1$ | $V_2$ | X |
|---|---|---|---|---|---|---|
| (II-13) | 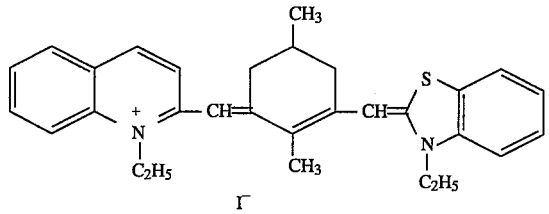 | | | | | |
| (II-14) | 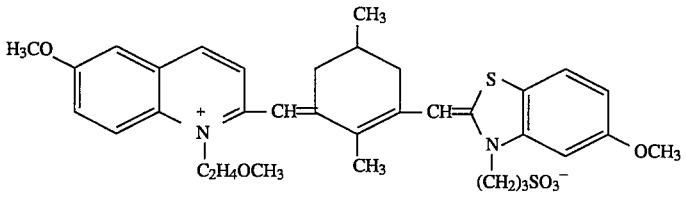 | | | | | |
| (II-15) | 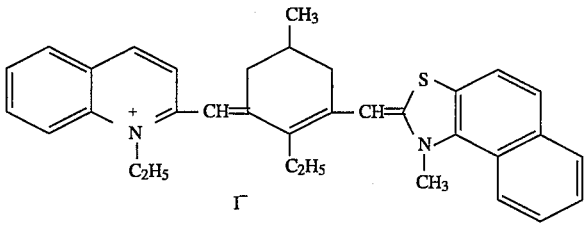 | | | | | |
| (II-16) | 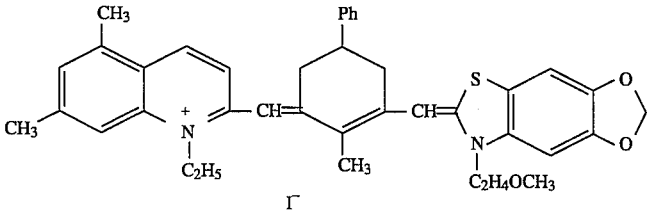 | | | | | |
| (II-17) | 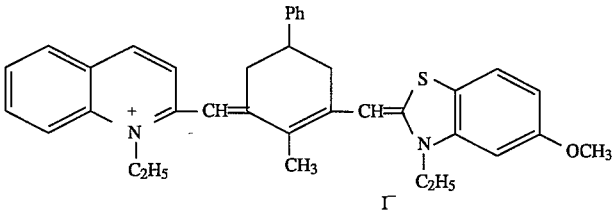 | | | | | |
| (II-18) | 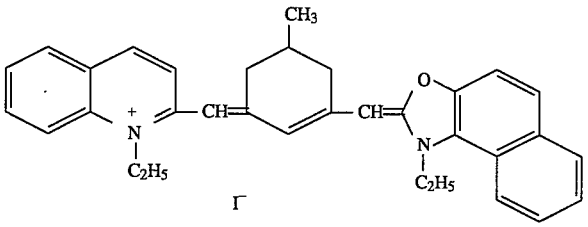 | | | | | |

-continued

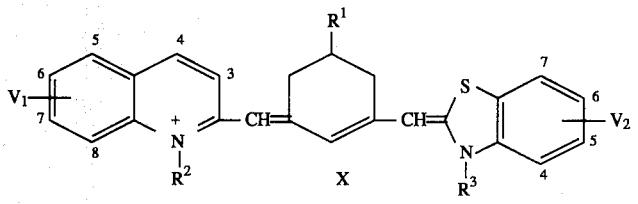

| No. | $R^1$ | $R^2$ | $R^3$ | $V_1$ | $V_2$ | X |
|---|---|---|---|---|---|---|
| (II-19) | | | | | | |
| (II-20) | | | | | | |
| (II-21) | | | | | | |
| (II-22) | | | | | | |

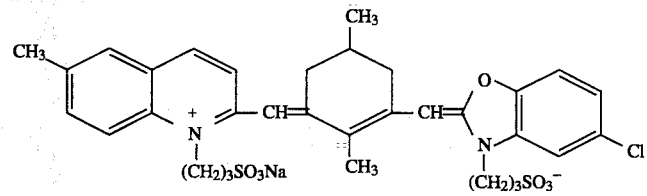

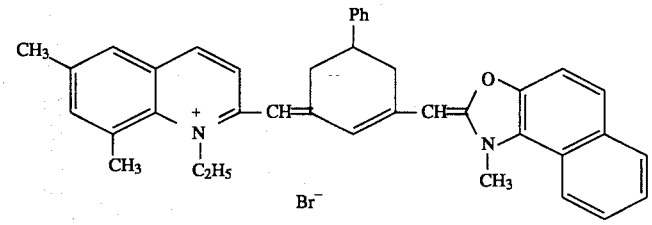

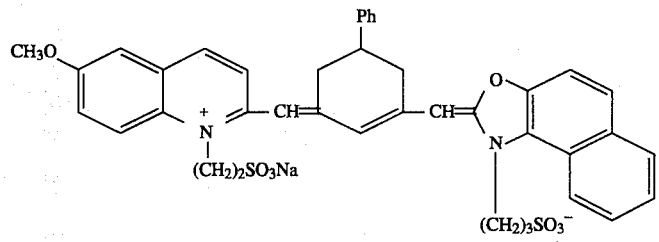

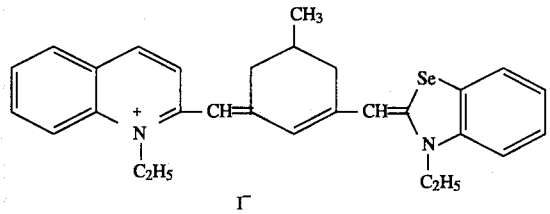

Note:

—Ph represents 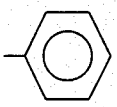 .

The polymethine dyes of general formula (I) or (II) which are used in the present invention can be synthesized by using the methods described in the following literature references or by referring thereto.

(a) F. M. Hamer, *Heterocyclic Compounds—Cyanine Dyes and Related Compounds—*, (John Wiley & Sons, New York, London, 1964).

(b) D. M. Sturmer, *Heterocyclic Compounds—Special Topics in Heterocyclic Chemistry—*, in Chapter 8, Paragraph 4, pp. 482–515 (John Wiley & Sons, New York, London, 1977) .

(c) Zh. *Zh. Org. Khim.*, Vol. 17, No. 1, pp. 167–169 (1981), ibid., Vol. 15, No. 4, pp. 400–407 (1979), ibid., Vo 1. 10, No. 10, pp. 2214–2221 (1978), ibid., Vol. 13, No. 11, pp. 2440–2443 (1977), ibid., Vol. 19, No. 10, pp. 2134–2142 (1983), *Ukr. Khim. Zh.*, Vol. 40, No. 6, pp. 625–629 (1974), *Khim. Geterotsikl. Soedin.*, No. 2, pp. 175–178 (1976), Russian Patents 420,643 and 341,823, JP-A-59-217761, U.S. Pat. Nos. 4,334,000, 3,671,648, 3,623,881, and 3,573,921, European Patent Laid-Open Nos. 288,261A1, 102,781A2 and 102,731A2 and JP-B-48-46930 (the term "JP-B" as used herein means an "examined Japanese patent publication").

The sensitizing dyes used in the present invention may be added to a silver halide emulsion at any stage conventionally considered to be effective during the course of the preparation of the emulsion. For example, the sensitizing dyes may be added before the formation of silver halide grains and/or desalting stage, or during the desalting stage and/or before the commencement of chemical sensitization after desalting as described in U.S. Pat. Nos. 2,735,766, 3,628,960, 4,183,756 and 4,225,666, JP-A-58-184142 and JP-A-60-196749, or may be added immediately before or during chemical ripening or at any stage before the coating of the emulsions after chemical ripening as described in JP-A-58-113920. Further, one compound alone or a combination of two or more compounds may be added portionwise, for example, during the formation of the grains and during chemical ripening or after completion of chemical ripening as described in U.S. Pat. No. 4,225,666 and JP-A-58-7629. If desired, the type of the compound to be portionwise added or the combination of the compounds to be portionwise added may be varied.

The amounts of the spectral sensitizing dyes of formula (I) or (II) to be added are different between M-band sensitization and J-band sensitization and vary depending on the form and size of the silver halide grains, but are generally $4\times10^{-6}$ to $8\times10^{-2}$ mol per mol of silver halide. For example, when the silver halide grains have a grain size of 0.2 to 1.3 μm, the dyes are added in an amount of preferably $2\times10^{-6}$ to $3.5\times10^{-3}$ mol, more preferably $7.5\times10^{-6}$ to $1.5\times10^{-3}$ mol, per mol of silver halide. Particularly, when J-band sensitization is to be conducted, it is preferred that a relatively large amount of the dyes is added, for example, the dyes are added in an amount of preferably $1.0\times10^{-3}$ to $2.0\times10^{-2}$ mol per mol of silver halide.

The sensitizing dyes used in the present invention may be directly dispersed in the emulsions. Alternatively, the sensitizing dyes may be dissolved in a solvent such as methyl alcohol, ethyl alcohol, methyl cellosolve, acetone, water or pyridine or in a solvent mixture thereof, and the resulting solution may be added to the emulsions. The dyes may be dissolved in the presence of additives such as a base, an acid or a surfactant or by using an ultrasonic wave. Examples of methods for adding the sensitizing dyes include a method wherein the dyes are dissolved in a volatile organic solvent, the resulting solution is dispersed in hydrophilic colloid, and the resulting dispersion is added to the emulsions as described in U.S. Pat. No. 3,469,987; a method wherein water-insoluble dyes are dispersed in a water-soluble solvent without dissolving the dyes, and the resulting dispersion is added to the emulsions as described in JP-B-46-24185; a method wherein the dyes are dissolved in a surfactant, and the resulting solution is added to the emulsions as described in U.S. Pat. No. 3,822,135; a method wherein the dyes are dissolved by using a compound which allows red shift to be caused, and the resulting solution is added to the emulsions as described in JP-A-51-74624; and a method wherein the dyes are dissolved in an acid which is substantially free from water, and the resulting solution is added to the emulsions. Further, the dyes can be added to the emulsions by using the methods described in U.S. Pat. Nos. 2,912,343, 3,342,605, 2,996,287 and 3,429,835.

The methine dyes of the present invention can be used as filter dyes, irradiation prevention dyes and antihalation dyes to improve sharpness and color separatability.

The methine dyes can be contained in coating solutions for silver halide photographic layers, filter layers and/or antihalation layers by using conventional methods. The dyes may be used in an amount sufficient to color the photographic layers. The amounts of the dyes to be used can be appropriately determined by those skilled in the art according to purpose. The dyes are generally used in such an amount as to give an optical density of preferably 0.05 to 3.0.

The dyes may be added at any stage before coating.

A polymer having an opposite charge to that of the dye ion may be allowed to coexist as a mordant in a dye-containing layer, and the dye may localized in a specific layer by an interaction between the polymer and the dye molecule.

Examples of the polymer mordant include those described in U.S. Pat. Nos. 2,548,564, 4,124,386, 3,625,694, 3,958,996, 4,168,976 and 3,445,231.

Examples of supersensitizing dyes which are useful in conducting spectral sensitization using the polymethine dyes of the present invention include pyrimidylamino compounds, triazinyl compounds and azolium compounds described in U.S. Pat. Nos. 3,511,664, 3,615,613, 3,615,632, 3,615,641, 4,596,767, 4,945,038, 4,965,182 and 5,061,018 and JP-A-4-146431. The methods for using them are preferably those described in the above-described patent specifications.

Any of silver bromide, silver iodobromide, silver iodochlorobromide, silver chlorobromide and silver chloride can be used as silver halide used in the photographic materials of the present invention. However, the preferred silver halide is silver bromide, silver chlorobromide, silver iodochlorobromide or high silver chloride described in JP-A-2-42.

The structures and processing of the photographic materials is described below. The structure and processing described in JP-A-2-42 can be preferably used particularly when silver halide is high silver chloride. The structure and processing described in JP-A-63-264743 can be preferably used, particularly when silver halide is silver chlorobromide.

Silver halide grains in the photographic materials may have a regular crystal form such as a cubic form, a tetradecahedral form or a rhombic dodecahedral form, an irregular crystal form such as a spherical form or a tabular form or a composite form of these crystal forms. A mixture composed of grains having various crystal forms may be used.

The silver halide grains may be different in phase between the interior of the grain and the surface layer thereof or may be composed of a uniform phase throughout the grain. The grains may be grains where a latent image is predominantly formed on the surface of the grain (e.g., negative type photographic materials), grains where a latent image is predominantly formed in the interior of the grain (e.g., internal latent image type photographic materials), or previously fogged grains (e.g., direct positive type photographic materials).

The silver halide grains having the above-described halogen compositions, crystal habit, grain structures and grain forms can be used in various photographic materials.

The methine dyes of the present invention can be used in the photographic materials to be applied to the following fields to use them as sensitizing agents, sensitizing dyes, filter dyes, antihalation dyes and irradiation-preventing dyes. The methine dyes of the present invention can be added to any desired layers such as interlayers, protective layers and back layers in addition to the light-sensitive emulsion layers.

The methine dyes of the present invention can be used in various color and black and white photographic materials.

More specifically, the methine dyes of the present invention can be used in color positive photographic materials, color paper photographic materials, color negative photographic materials, reversal color photographic materials (with or without couplers), direct positive silver halide photographic materials, photographic materials for plate making (e.g., lith films, lith duplicating films), photographic materials for cathode ray tube display, X-ray photographic materials (particularly films for direct or indirect photographing using a screen), photographic materials for use in a silver salt diffusion transfer process, photographic materials for use in a color diffusion transfer process, photographic materials for use in an inhibition process, photographic materials for use in a silver dye bleaching process, and heat developing photographic materials.

The silver halide photographic emulsions which can be used in the present invention can be prepared by using the methods described in P. Glafkides, *Chimie et Physique Photographique* (Paul Montel 1967), G. F. Duffin, *Photographic Emulsion Chemistry* (The Focal Press 1966) and V. L. Zelikman et al., *Making and Coating Photographic Emulsion* (The Focal Press 1964).

Ammonia, potassium rhodanide, ammonia rhodanide, thioethers (e.g., those described in U.S. Pat. Nos. 3,271,157, 3,574,628, 3,704,130, 4,297,439 and 4,276,374), thione compounds (e.g., those described in JP-A-53-144319, JP-A-53-82408 and JP-A-55-77737), and amine compounds (e.g., those described in JP-A-54-100717) can be used as solvents for silver halide to control the growth of the silver halide grains during their formation.

A cadmium salt, a zinc salt, a thallium salt, an iridium salt or a complex salt thereof, a rhodium salt or a complex salt thereof, or an iron salt or a complex salt thereof may be present during the course of the formation of the silver halide grains or during the physical ripening thereof.

Examples of internal latent image type silver halide emulsions which can be used in the present invention include conversion type silver halide emulsions, core/shell type silver halide emulsions and silver halide emulsions containing different metals therein described in U.S. Pat. Nos. 2,592,250, 3,206,313, 3,447,927, 3,761,276 and 3,935,014.

Usually, the silver halide emulsions are chemically sensitized. Chemical sensitization can be carried out, for example, by using the methods described in H. Frieser, *Die Grundlagen der Photographischen Prozesse mit Silberhalogeniden* (Akademische Verlagsgesellschaft 1968), pp. 67–734.

Namely, the sulfur sensitizing method using a sulfur-containing compound capable of reacting with active gelatin and silver (e.g., a thiosulfate, a thiourea, a mercapto compound, a rhodanine or the like); the selenium sensitization method; the reduction sensitization method using a reducing material (e.g., a stannous salt, an amine, a hydrazine derivative, formamidinesulfonic acid or a silane compound); and the noble metal sensitization method using a noble metal compound (e.g., a gold complex salt, or a complex salt of Group VIII metal such as Pt, Ir, Pd or the like) can be used. These methods may be used either alone or in combination.

The photographic materials used in the present invention may contain various compounds to prevent fogging from occurring during the preparation, storage or processing of the photographic materials or to stabilize the photographic performance thereof. Examples of the anti-fogging agents or the stabilizers include: thiazoles such as benzthiazolium salts described in U.S. Pat. Nos. 3,954,478 and 4,942,721 and JP-A-59-191032 and the ring opening compounds thereof described in JP-B-59-26371, nitroindazoles, triazoles, benztriazoles, benzimidazoles (particularly nitro- or halogen-substituted compounds); heterocyclic mercapto compounds such as mercapto thiazoles, mercaptobenzthiazoles, mercaptobenzimidazoles, mercaptothiadiazoles, mercaptotetrazoles (particularly 1-phenyl-5-mercaptotetrazole), mercaptopyrimidines; heterocyclic mercapto compounds having a water-soluble group such as a carboxyl group or a sulfo group; thioketone compounds such as oxazolinethione; azaindenes such as tetrazaindenes (particularly 4-hydroxy-substituted (1,3,3a,7)tetrazaindenes); benzenethiosulfonic acids; benzenesulfonic acids; and acetylene compounds described in JP-A-62-87957.

The silver halide photographic materials of the present invention can contain color couplers such as cyan couplers, magenta couplers and yellow couplers and compounds for use in dispersing these couplers.

Namely, the silver halide photographic materials can contain compounds capable of forming colors by the oxidative coupling thereof with aromatic primary developing agents (e.g., phenylenediamine derivatives, aminophenol derivatives) in the color development stage. Examples of the magenta couplers include 5-pyrazolone couplers, pyrazolobenzimidazole couplers, cyanoacetyl-coumarone couplers and ring open acylacetonitrile couplers. Examples of the yellow couplers include acylacetamide couplers (e.g., benzoyl acetanilides, pivaloylacetanilides). Examples of the cyan couplers include naphthol couplers and phenol couplers. It is preferred that these couplers have a hydrophobic group called a ballast group so that the couplers are non-diffusing. The couplers may be any of the four equivalent type or the two equivalent type to silver ion. Colored couplers having an effect of correcting colors and couplers which release a restrainer (socalled DIR couplers) during development may be used.

In addition to the DIR couplers, non-color forming DIR coupling compounds which form a colorless product by the coupling reaction and release a restrainer may be used.

The photographic materials of the present invention may contain polyalkylene oxides or ethers or esters thereof or amine derivatives thereof, thioether compounds, thiomorpholines, quaternary ammonium chloride compounds, urethane derivatives, urea derivatives, imidazole derivatives and 3-pyrazolidones to increase sensitivity or contrast or to accelerate development.

The silver halide photographic materials of the present invention may contain various dyes as filter dyes or irradiation preventing dyes in addition to the compounds of formula (i) or formula (II) according to the present invention.

Examples of the dyes include oxonol dyes having a pyrazolone nucleus or a barbituric acid nucleus described in U.K. Patents 506,385, 1,177,429, 1,311,884, 1,338,799, 1,385,371, 1,467,214, 1,433,102 and 1,553,516, JP-A-48-85130, JP-A-49-114420, JP-A-52-117123, JP-A-55-161233, JP-A-59-111640, JP-B-39-22069, JP-B-43-13168, JP-A-62-273527, and U.S. Pat. Nos. 3,247,127, 3,469,985 and 4,078,933; oxonol dyes described in U.S. Pat. Nos. 2,533,472 and 3,379,533, U.K. Patent 1,278,621, JP-A-l-134447 and JP-A-l-183652; azo dyes described in U.K. Patents 575,691, 680,631, 599,623, 786,907, 907,125 and 1,045,609, U.S. Pat. No. 4,255,326 and JP-A-59-211043; azomethine dyes described in JP-A-50-100116, JP-A-54-118247 and U.K. Patents 2,014,598 and 750,031; anthraquinone dyes described in U.S. Pat. No. 2,865,752; arylidene dyes described in U.S. Pat. Nos. 2,533,009, 2,688,541 and 2,538,008, U.K. Patents 584,609 and 1,210,252, JP-A-50-40625, JP-A-51-3623, JP-A-51-10927, JP-A-54-118247, JP-B-48-3286 and JP-B-59-37303; styryl dyes described in JP-B-28-3082, JP-B-44-16594 and JP-B-59-28898; triarylmethane dyes described in U.K. Patents 446,583 and 1,335,422 and JP-A-59-228250; merocyanine dyes described in U.K. Patents 1,075,653, 1,153,341, 1,284,730, 1,475,228 and 1,542,807; and cyanine dyes described in U.S. Pat. Nos. 2,843,486 and 3,294,539 and JP-A-1-291247.

These dyes can be prevented from diffusing in the following manner.

For example, a hydrophilic polymer having an opposite charge to that of the dissociated anionic dye is allowed to be present as a mordant in a layer, and the dyes are localized in that specific layer by an interaction between the polymer and the dye compound. This method is disclosed in U.S. Pat. Nos. 2,548,564, 4,124,386 and 3,625,694.

A method for dyeing a specific layer by using a water-insoluble dye solid is disclosed in JP-A-56-12639, JP-A-55-155350, JP-A-55-155351, JP-A-63-27838, JP-A-63-197943 and European Patent 15,601.

A method for dyeing a specific layer by using fine metal salt particles containing a dye adsorbed thereon is disclosed in U.S. Pat. Nos. 2,719,088, 2,496,841 and 2,496,843 and JP-A-60-45237.

The photographic materials of the present invention may contain various surfactants as coating aids or to impart antistatic properties, to improve slipperiness and emulsifying dispersion, to prevent sticking from occurring or to improve photographic characteristics (e.g., development acceleration, high contrast, sensitization).

In the practice of the present invention, additives are used in the silver halide emulsions and hydrophilic colloid. Examples of the additives include anti-fading agents, inorganic or organic hardening agents, color fogging inhibitors, ultraviolet light absorbers, mordants, plasticizers, latex polymers and matting agents. Specific examples thereof are described in *Research Disclosure,* Vol. 176, No. 17643 (December, 1978).

Hydrophilic polymers such as gelatin are used as protective colloid in the photographic materials of the present invention.

The finished silver halide emulsions are coated on an appropriate support such as barayta paper, resin-coated paper, synthetic paper, triacetate film, polyethylene terephthalate film, other plastic bases or a glass sheet.

Exposure to light may be carried out in a conventional manner to obtain a photographic image. Any conventional light source, such as natural light (sunlight), a tungsten lamp, a fluorescent lamp, a mercury vapor lamp, a xenon arc lamp, a carbon arc lamp, a xenon a flushing lamp and a cathode ray tube flying spot can be used. The exposure time may be a time ranging from 1/1000 to 1 sec which is conventionally applied to cameras. If desired, a shorter exposure time than 1/1000 sec may be used. For example, an exposure time of $1/10^4$ to $1/10^6$ sec may be used with a xenon flush lamp or a cathode ray tube. Further, a longer exposure time than one second may be used. If desired, the spectral composition of light used for exposure may be controlled by using a color filter. Laser beams may be used to conduct exposure to light. Exposure to light may be carried out by light emitted from phosphors excited by electron beam, X-rays, gamma rays or alpha rays.

The photographic materials of the present invention may be processed by using conventional methods and processing solutions described in *Research Disclosure,* Vol. 176, pp. 28–30, No. 17643. The photographic processing may be photographic processing for forming a silver image (black and white photographic processing) and photographic processing for forming a dye image (color photographic processing). The processing temperature is usually in the range of 18° to 50° C. However, a lower temperature than 18° C. or a higher temperature than 50° C. may be used.

The present invention is now illustrated in greater detail by reference to the following examples which, however, are not to be construed as limiting the invention in any way.

In the example, the term "λmax", "ε", and "m.p." as used herein mean "absorption maximum in methanol", "absorption coefficient", and "melting point", respectively.

EXAMPLE 1

Synthesis of Dye (I-5)

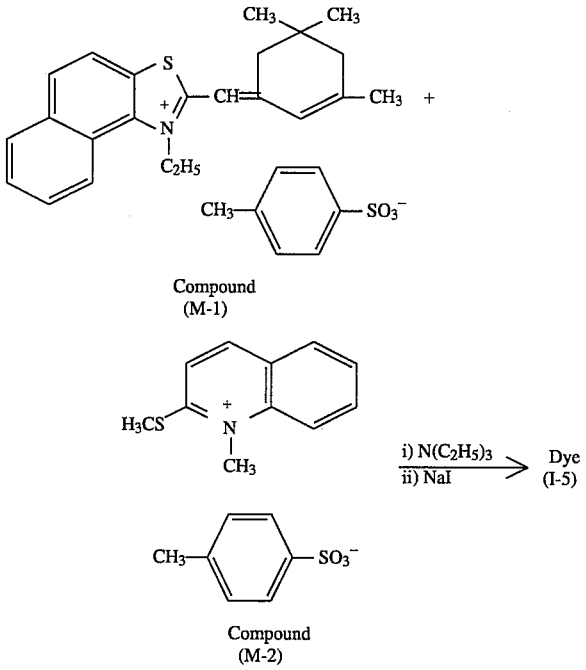

To a solution of 0.52 g of Compound (M-1) and 0.36 g of Compound (M-2) in 5 ml of acetonitrile, there was added 0.3 ml of triethylamine. The mixture was stirred at 80° C. for one hour. The reaction mixture (solution) was cooled, and 50 ml of ethyl acetate was added thereto. After decantation, an aqueous solution of sodium iodide was added to the residue, and the crystal formed was recovered by filtration. The resulting crude crystal was completely dissolved in a mixed solution of methanol and methylene chloride, and the solvents were then distilled off under reduced pressure. After cooling, the crystal formed was collected by filtration and dried to obtain 0.35 g of the desired Dye (I-5).

Yield 58%

$\lambda_{max}$=709 nm (MeOH)

$\epsilon$=7.25'$10^4$ m.p.=236° C.

EXAMPLE 2

Synthesis of Dye (I-6)

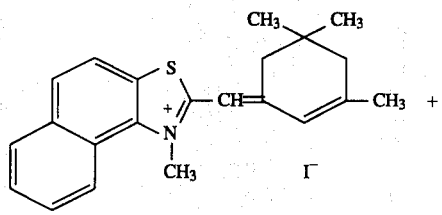

Compound (M-3)

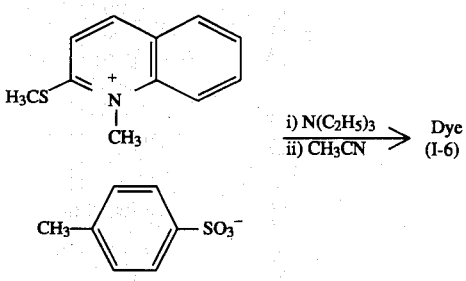

Compound (M-2)

To a solution of 0.92 g of Compound (M-3) and 0.72 g of Compound (M-2) in 10 ml of acetonitrile, there was added 1.0 ml of triethylamine. The mixture was stirred at 80° C. for one hour. The reaction mixture (solution) was cooled, and 80 ml of ethyl acetate was added thereto. The crystal formed was collected by filtration. The resulting crude crystal was completely dissolved in a mixed solution of ethanol and methylene chloride, and the solvents were then distilled off under reduced pressure. After cooling, the crystal formed was collected by filtration and dried to obtained 0.65 g of the desired Dye (I-6).

Yield 54%

$\lambda_{max}$=710 nm (MeOH)

$\epsilon$=8.32×10$^4$ m.p.=165° C.

EXAMPLE 3

Synthesis of Dye (II-5)

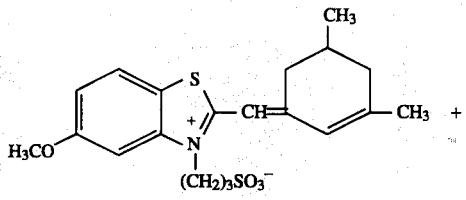

Compound (M-4)

-continued

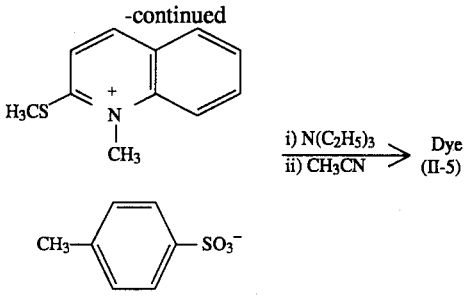

Compound (M-2)

The reaction was repeated in the same manner as in Example 2, except that 0.50 g of Compound (M-4) and 0.36 g of Compound (M-2) were used to obtain 0.10 g of the desired Dye (II-5).

Yield 18%

$\lambda_{max}$=703 nm (MeOH)

$\epsilon$=7.80×10$^4$ m.p.=203° to 210° C. (decomposition)

EXAMPLE 4

Synthesis of Dye (II-9)

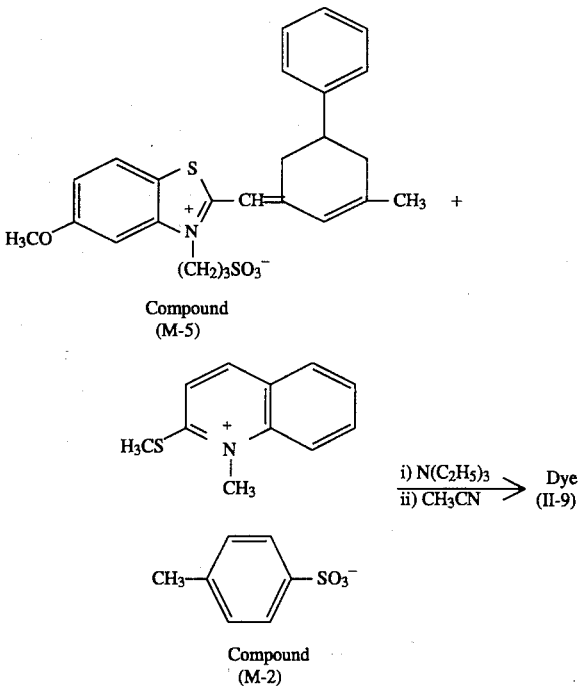

Compound (M-5)

Compound (M-2)

The reaction was repeated in the same manner as in Example 2, except that 1.0 of Compound (M-5) and 0.7 g of Compound (M-2) were used to obtain 0.10 g of the desired Dye (II-9).

Yield 8.4%

$\lambda_{max}$=705 nm (MeOH)

$\epsilon$=7.20'10$^4$ m.p.=220° to 223° C. (decomposition)

The following examples illustrate the photographic materials according to the present invention. It is understood, however, that the examples are intended for illustration only and it is not intended that the invention be limited thereto.

EXAMPLE 5

To a reaction vessel, there were added 1000 ml of water, 25 g of deionized ossein gelatin, 15 ml of a 50% aqueous solution of $NH_4NO_3$, and 7.5 ml of a 25% aqueous solution of $NH_3$. While the resulting aqueous solution was kept at 50° C. with vigorous stirring, 750 ml of an aqueous solution of 1N silver nitrate and an aqueous solution of 1N potassium bromide were added thereto over a period of 50 minutes. During the course of the reaction, the silver potential was kept at +50 mV to a saturated calomel electrode.

The resulting silver bromide grains were cubic with a side length of 0.77±0.06 μm. The temperature of the emulsion prepared above was lowered, and a copolymer of isobutene and monosodium maleate as the flocculating agent was added thereto. The emulsion was washed with water and desalted by a precipitation method. Subsequently, 90 g of deionized ossein gelatin and 430 ml of water were added to the emulsion. The pH of the emulsion was adjusted to 6.5, and the pAg thereof was adjusted to 8.3 at 50° C. (The emulsion is referred to as Emulsion (1)). The emulsion contained 0.74 mol of silver bromide per kg of the emulsion. Emulsion (1) was divided into two portions. To one portion thereof, there were added sodium thiosulfate, sodium chloroaurate and potassium thiocyanate. The emulsion was ripened at 60° C. for 45 minutes so as to give optimum sensitivity. (The resulting emulsion is referred to as Emulsion (2)). A 50 g portion of Emulsion (1) was taken, and a solution of $2.7\times10^{-4}$ mol (per mol of silver bromide) of the sensitizing dyes shown in Table 1 below were added thereto at 60° C. for 15 minutes. The emulsion was then ripened at that temperature for 20 minutes. Subsequently, $4.0\times10^{-4}$ mol of 4-hydroxy-5,6-propano-1,3,3a,7-tetrazaindene per mol of silver bromide was added thereto. After 5 minutes, sodium thiosulfate, sodium chloroaurate and potassium thiocyanate were added thereto, and the emulsion was ripened at 60° C. or 45 minutes so as to give optimum sensitivity.

Separately, a 50 g portion of Emulsion (2) was taken, and $5.5\times10^{-5}$ mol (per mol of silver bromide) of the sensitizing dye shown in Table 1 below was added thereto. Subsequently, $4.5\times10^{-4}$ mol of disodium 4,4'-bis(2,6-di(2-naphthoxy)pyrimidine-4-ylamino)stilbene2,2'-disulfonate and $1.0\times10^{-3}$ mol of 4-hydroxy-6-methyl-1,3,3a,7-tetrazaindene were added thereto.

To each of the emulsions, there were added 15 g of a 10% gel of deionized gelatin and 55 ml of water. The emulsion was coated on a cellulose triacetate film base in such an amount as to give a coating weight of 2.5 g/m$^2$ in terms of silver and a gelatin coating weight of 3.8 g/m$^2$. An aqueous solution mainly composed of 0.22 g/l of sodium dodecylbenzenesulfonate, 0.50 g/l of sodium p-sulfostyrene homopolymer, 3.9 g/l of 1,3-bis-(vinylsulfonyl)-2-propanol, and 50 g/l of gelatin was simultaneously coated thereon in such an amount as to give a gelatin coating weight of 1.0 g/m$^2$, thereby forming an upper layer.

The absorption spectrums of the thus-prepared coated samples were measured by using the spectrophotometer U-3410 equipped with an integrating sphere (manufactured by Hitachi, Ltd.). Further, the samples were spectrally exposed to light through a wedge by using an equienergy spectral exposure device. The exposed samples were developed with developing solution D-72, stopped, fixed, washed with water and dried. The sensitivity of each sample at the maximum wavelength of spectral sensitivity, at a wavelength of (the maximum wavelength of spectral sensitivity+30 nm) and at a wavelength of (the maximum wavelength of spectral sensitivity−30 nm) was determined. The reciprocal of the exposure amount providing an optical density of (fog+0.2) is referred to as the sensitivity.

The ratio of the sensitivity [S(max)] at the maximum wavelength of spectral sensitivity to the sensitivity [S(-30 nm)] at a wavelength which is shorter by 30 nm than the maximum wavelength of spectral sensitivity, the ratio of the sensitivity IS(max)] to the sensitivity [S(+30 nm)] at a wavelength which is longer by 30 nm than the maximum wavelength of spectral sensitivity, the ratio of absorbance [Abs(max)] at the longest wavelength absorption maximum wavelength to absorbance labs(−30 nm)] at a wavelength which is shorter by 30 nm than the absorption maximum wavelength, and the ratio of absorbance [Abs(max)] to absorbance labs(+30 nm)] at a wavelength which is longer by 30 nm than the absorption maximum wavelength, are shown in Table 1 below.

As is apparent from Table 1, the compound of the present invention have sharp absorption in a near infrared region (particulary 800 nm or more).

TABLE 1

| Sample No. | Emulsion | Sensitizing Dye | λS(max) (nm) | S(max)/ S(−30 nm) | S(max)/ S(+30 nm) | Abs (max)/ Abs(−30 nm) | Abs (max)/ Abs(+30 nm) |
|---|---|---|---|---|---|---|---|
| (1-1) | (1) | (I-5) | 850 | 1.74 | 2,39 | 1.62 | 2.16 |
| (1-2) | (1) | (I-6) | 855 | 1.65 | 4.17 | 1.57 | 3.17 |
| (1-3) | (1) | (II-5) | 817 | 1.56 | 2.95 | 1.63 | 2.52 |
| (1-4) | (1) | (II-6) | 795 | 1.48 | 2.19 | 1.32 | 2.04 |
| (1-5) | (2) | (I-5) | 765 | 1.25 | 1.65 | 1.22 | 1.55 |

λS(max): Maximum wavelength of spectral sensitivity
S(max): Sensitivity at the maximum wavelength of spectral sensitivity
S(−30 nm): Sensitivity at a wavelength which is shorter by 30 nm than the maximum wavelength of spectral sensitivity
S(+30 nm): Sensitivity at a wavelength which is longer by 30 nm than the maximum wavelength of spectral sensitivity
Abs(max): Absorbance at the longest wavelength absorption maximum wavelength
Abs(−30 nm): Absorbance at a wavelength which is shorter by 30 nm than the longest wavelength absorption maximum wavelength
Abs(+30 nm): Absorbance at a wavelength which is longer by 30 nm than the longest wavelength absorption maximum wavelength

EXAMPLE 6

The silver halide emulsion used in Example 6 was prepared in the following manner.

| | |
|---|---|
| Solution 1 | |
| Water | 1000 ml |
| NaCl | 4.65 g |
| Gelatin | 22 g |
| Citric Acid | 0.80 g |
| Solution 2 | |
| KBr | 25.3 g |
| NaCl | 32.3 g |
| $K_2IrCl_6$ (0.005%) | 11.2 ml |
| $Na_3RhCl_6.2H_2O$ ($10^{-5}$ mol/l) | 18.9 ml |
| Water to make | 348 ml |
| Solution 3 | |
| $AgNO_3$ | 120.6 g |
| Water to make | 348 ml |
| Solution 4 | |
| KBr | 30.0 g |
| NaCl | 48.7 g |
| Water to make | 552 ml |
| Solution 5 | |
| $AgNO_3$ | 176.3 g |
| Water to make | 552 ml |

Solution 1 was heated to 50° C., and 262 ml of Solution 2 and 262 ml of Solution 3 were simultaneously added thereto at a given flow rate over a period of 12 minutes. Subsequently, Solution 4 and Solution 5 were simultaneously added thereto over a period of 20 minutes. A methanol solution of $7.0\times10^{-4}$ mol of sensitizing Dye (I-5) per mol of silver chlorobromide was added thereto at a given rate over a period of 10 minutes, until the addition of Solutions 4 and 5 was completed after 10 minutes from the commencement of the addition of those solutions. Subsequently, the temperature of the resulting emulsion was lowered, and a copolymer of isobutene and monosodium maleate as a flocculating agent was added thereto. The emulsion was washed with water and desalted by a precipitation method. Water and deionized ossein gelatin were added thereto. The pH of the emulsion was adjusted to 6.1, and the pAg thereof was adjusted to 7.5. Subsequently, $4\times10^{-4}$ mol of 4-hydroxy-5,6-propano-1,3,3a,7-tetrazaindene per mol of silver was added to the emulsion. The emulsion was ripened at 60° C. for 10 minutes, and sodium thiosulfate, chloroauric acid and potassium thiocyanate were then added thereto. Optimum chemical sensitization was carried out, thus preparing a monodisperse cubic silver chlorobromide emulsion comprising grains having a grain size of 0.28 μm in terms of average side length, a coefficient of variation (a value s/b obtained by dividing standard deviation by the average side length) of 0.08 and a silver bromide content of 30 mol %.

Separately, a silver chlorobromide emulsion was prepared in the same manner as described above, except that sensitizing Dye (I-6) was used in place of sensitizing Dye (I-5).

Subsequently, 0.65 g of 4-hydroxy-6-methyl-1,3,3a,7-tetrazaindene, 280 g of a 10% gel of deionized gelatin, 1.04 l of water, and 7 g of 1,2-bis(vinyl-sulfonylacetylamino)ethane were added to each emulsion, each amount being per kg of the emulsion (containing one mol of silver). The emulsion was coated on a polyethylene terephthalate film base in the same manner as in Example 5 in such an amount as to give a coating weight of 1.2 g/m$^2$ in terms of silver.

The thus-prepared coated samples were processed in the same manner as in Example 5 except that development processing was carried out at 38° C. for 20 seconds by using the automatic processor FD-800RA (manufactured by Fuji Photo Film Co., Ltd.) and the developing solution LD-835 (manufactured by Fuji Photo Film Co., Ltd.). In the same manner as in Example 5, the absorption spectrum of each sample and the sensitivity of each sample at a maximum wavelength of spectral sensitivity, at a wavelength of (the maximum wavelength of spectral sensitivity–30 nm) and at a wavelength of (the maximum wavelength of spectral sensitivity+30 nm) were determined. The ratio of the sensitivity and the ratio of absorbance are shown in Table 2 below.

TABLE 2

| Sample No. | Sensitizing Dye | λS(max) (nm) | S(max)/S(−30 nm) | S(max)/S(+30 nm) | Abs(max)/Abs(−30 nm) | Abs(max)/Abs(+30 nm) |
|---|---|---|---|---|---|---|
| (2-1) | (I-5) | 850 | 2.04 | 2.69 | 1.92 | 2.37 |
| (2-2) | (I-6) | 855 | 1.91 | 3.89 | 1.76 | 3.45 |

EXAMPLE 7

The silver halide emulsion used in Example 7 was prepared in the following manner.

To a 3% aqueous solution of lime-processed gelatin, there was added 3.3 g of sodium chloride. Subsequently, 3.2 ml of a 1% aqueous solution of N,N'-dimethylimidazolidine-2-thione was added thereto. To the resulting aqueous solution, there were added an aqueous solution containing 0.2 mol of silver nitrate and an aqueous solution containing 15 μg of rhodium trichloride and 0.2 mol of sodium chloride with vigorous stirring at 56° C. Subsequently, an aqueous solution containing 0.780 mol of silver nitrate and an aqueous solution containing 0.780 mol of sodium chloride and 4.2 mg of potassium ferrocyanide were added thereto with vigorous stirring at 56° C. Five minutes after completion of the addition of the aqueous solution of silver nitrate and the aqueous solution of sodium chloride, an aqueous solution containing 0.020 mol of silver nitrate and an aqueous solution containing 0.015 mol of potassium bromide, 0.005 mol of sodium chloride and 0.8 mg of potassium hexachloroiridate (IV) were added thereto with vigorous stirring at 40° C. A high-molecular flocculating agent was added thereto to form a precipitate. The emulsion was desalted and washed with water.

Subsequently, $4.5\times10^{-4}$ mol of 4-hydroxy-5,6-propano-1,3,3a,7-tetrazaindene per mol of silver was added thereto. A methanol solution of $3.8\times10^{-4}$ mol of sensitizing Dye (I-6) per mol of silver was added thereto at 60° C., and the emulsion was ripened for 30 minutes. Subsequently, 90.0 g of lime-processed gelatin and triethylthiourea were added thereto. The emulsion was ripened at 55° C. so as to give optimum sensitivity. After chemical sensitization, $5.0\times10^{-4}$ mol of 4-hydroxy-5,6-propano-1,3,3a,7-tetrazaindene per mol of silver was added thereto.

The silver chlorobromide grains contained in the thus-prepared emulsion were cubic, and the grains had a mean grain size of 0.52 μm (a coefficient of variation: 0.08). The diameter of the grain is defined as the diameter of a circle having an area equal to the projected area of the grain, and the average of the diameters of the grains is referred to as the mean grain size. The coefficient of variation is a value obtained by dividing the standard deviation of the grain size by the mean grain size.

The halogen composition of the emulsion grains was determined from the silver halide crystal by X-ray diffractometry.

The angle of diffraction from the (200) face was fully measured by using monochromatized CuK(α) rays as the radiation source. The diffraction pattern obtained from a crystal having a uniform halogen composition gives a single peak. On the other hand, the diffraction pattern obtained from a crystal having a localized phase having a different halogen composition from that of the host crystal gives a plurality of peaks corresponding to the composition. The halogen composition of the silver halide crystal can be determined by calculating the lattice constant from the angle of diffraction of the peak measured.

The results obtained by measuring the silver chlorobromide emulsion prepared above are such that in addition to the main peak of 100% silver chloride, there can be observed a broad diffraction pattern wherein the center of the curve is 70 mol % of silver chloride (30 mol % of silver bromide) and the foot is extended nearly to a point where silver chloride is 60 mol % (silver bromide is 40 mol %).

The emulsion together with color couplers described below was coated on a paper support (both sides thereof being previously laminated with polyethylene) to prepare a sample. The coating solution was prepared in the following manner.

19.1 g of Yellow Coupler (Ex-Y), 4.4 g of Dye Image Stabilizer (Cpd-1) and 1.4 g of Dye Image Stabilizer (Cpd-2) were dissolved in 27.2 ml of ethyl acetate and 8.2 g of Solvent (Solv-1). The resulting solution was emulsified and dispersed in 185 ml of a 10% aqueous gelatin solution containing 8 ml of a 10% aqueous solution of dodecylbenzenesulfonic acid. The resulting emulsified dispersion and the silver chlorobromide emulsion were mixed at 40° C. and dissolved, and a coating solution was prepared so as to give the following composition.

A protective layer was provided as the upper layer on the emulsion layer. Sodium salt of 2-hydroxy-4,6-dichloro-1,3,5-triazine was used as the hardening agent for gelatin in each layer.

Each layer had the following composition. Numerals described below represent coating weights ($g/m^2$). The amount of the silver halide emulsion is represented by the coating weight in terms of silver.

Support

Polyethylene-Laminated Paper

[Polyethylene on the first layer side contained a white pigment ($TiO_2$) and a bluish dye (ultramarine)]

| | |
|---|---|
| Silver Chlorobromide Emulsion Layer (Yellow color forming layer) | |
| The above Silver Chlorobromide Emulsion | 0.30 |
| Gelatin | 1.86 |
| Yellow Coupler (ExY) | 0.82 |
| Dye Image Stabilizer (Cpd-1) | 0.19 |
| Dye Image Stabilizer (Cpd-2) | 0.06 |
| Solvent (Solv-1) | 0.35 |
| Upper Layer (Protective Layer) | |
| Gelatin | 1.33 |
| Acrylic-Modified Copolymer of Polyvinyl Alcohol (a degree of modification: 17%) | 0.17 |
| Liquid Paraffin | 0.03 |

(ExY) Yellow Coupler

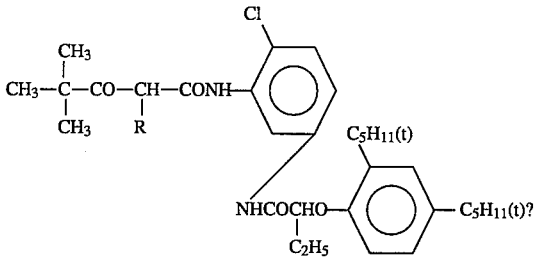

1:1 Mixture (by mol) of

R =

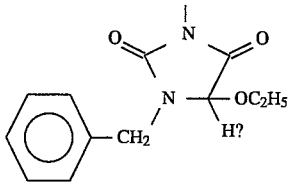

R =

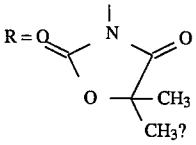

(Cpd-1) Dye Image Stabilizer

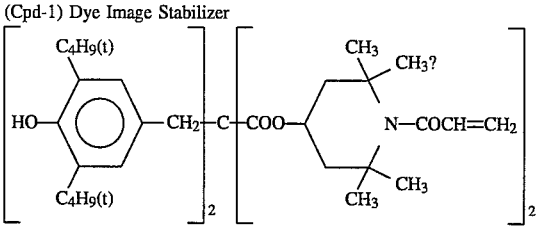

(Cpd-1) Dye Image Stabilizer $\leftarrow CH_2-CH\rightarrow_n$ $CONHC_4H_9(t)$ (Average M.W. = 60,000)?

(Solv-1) Solvent

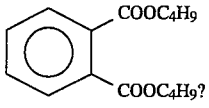

The reflection absorption spectrum of the thus-prepared coated sample was measured in the same manner as in Example 5. Exposure to light was conducted in the same manner as in Example 5 to determine spectral sensitivity. However, processing was carried out with the following processing solutions in the following processing stages. The reciprocal of the exposure amount providing a color density of (fog+0.5) is referred to as the sensitivity.

The ratio of the sensitivity obtained and the ratio of absorbance obtained are shown in Table 3 below.

TABLE 3

| Sample No. | Sensitizing Dye | λS(max) (nm) | S(max)/ S(−30 nm) | S(max)/ S(+30 nm) | Abs(max)/ Abs(−30 nm) | Abs(max)/ Abs(+30 nm) |
|---|---|---|---|---|---|---|
| (3-1) | (I-6) | 857 | 1.74 | 4.07 | 1.66 | 3.31 |

| Processing Stage | Temperature (°C.) | Time (sec) | Replenishment rate (ml) | Tank capacity (l) |
|---|---|---|---|---|
| Color development | 35 | 45 | 161 | 17 |
| Bleaching-fixing | 30–35 | 45 | 215 | 17 |
| Rinse (1) | 30–35 | 20 | — | 10 |
| Rinse (2) | 30–35 | 20 | — | 10 |
| Rinse (3) | 30–35 | 20 | 350 | 10 |
| Drying | 70–80 | 60 | | |

(Three tank countercurrent system of from rinse (3) → rinse (1) was used.)
*Replenishment rate being per $m^2$ of the photographic material.

The processing solutions had the following compositions.

| Color Developing Solution | Tank Solution | Replenisher |
|---|---|---|
| Water | 800 ml | 800 ml |
| Ethylenediamine-N,N,N,N-tetramethylenephosphonic Acid | 1.5 g | 2.0 g |
| Triethanolamine | 8.0 g | 12.0 g |
| Sodium Chloride | 1.4 g | — |
| Potassium Carbonate | 25.0 g | 25.0 g |
| N-Ethyl-N-(β-methanesulfonamidoethyl)-3-methyl-4-aminoaniline Sulfate | 5.0 g | 7.0 g |
| N,N-Bis(carboxymethyl)-hydrazine | 5.5 g | 7.0 g |
| Fluorescent Brightener (WHITEX 4B manufactured by Sumitomo Chemical Co., Ltd.) | 1.0 g | 2.0 g |
| Water to make | 1000 ml | 1000 ml |
| pH (25° C.) | 10.05 | 10.45 |

Bleaching-Fixing Solution
Tank solution and replenisher being the same.

| | |
|---|---|
| Water | 800 ml |
| Ammonium Thiosulfate (70%) | 100 ml |
| Sodium Sulfite | 17 g |
| Ammonium Ethylenediaminetetraacetato Ferrate | 55 g |
| Disodium Ethylenediaminetetraacetate | 5 g |
| Ammonium Bromide | 40 g |
| Water to make | 1000 ml |
| pH (25° C.) | 6.0 |

Rinsing Solution

Tank solution and replenisher being the same. Ion-exchanged water (the concentration of each of the calcium ion and magnesium ion being reduced to 3 ppm or lower)

It can be understood from the results shown above that the sensitizing dyes of the present invention can easily form J-associate and are particularly advantageous in that the sensitizing dyes have a sharp absorption band in the infrared region.

The compounds of general formula (I) or (II) are useful as spectral sensitizing dyes having sharp absorption in the infrared region when used in the silver halide photographic emulsions, and further the compounds can be used as dyes.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide emulsion layer, wherein the layer contains at least one compound represented by formula (I):

(I)

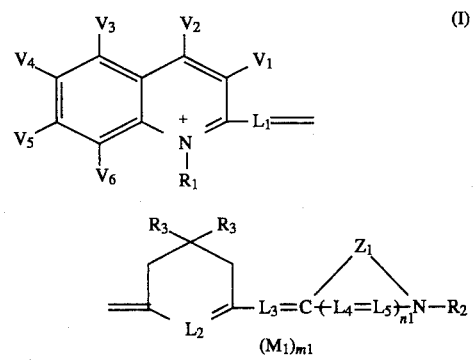

wherein $Z_1$ represents an atomic group required for forming a five-membered or six-membered nitrogen-containing heterocyclic ring;

$R_1$ and $R_2$ each represents an alkyl group;

two $R_3$groups represent an alkyl group, an aryl group, or a heterocyclic group;

$V_1$, $V_2$, $V_3$, $V_4$, $V_5$ and $V_6$ each represents a hydrogen atom or a substituent;

$L_1$, $L_2$, $L_3$, $L_4$ and $L_5$ each represents a methine group;

$n_1$ represents 0 or 1;

$M_1$ represents an ion for neutralizing charge; and $m_1$ represents a number of 0 or more which is required for neutralizing charge in the compound.

2. The silver halide photographic material as in claim 1, wherein the heterocyclic ring formed by $Z_1$ is a benzthiazole, naphthothiazole, benzoxazole, or naphthoxazole nucleus.

3. The silver halide photographic material as in claim 1, wherein the alkyl group represented by $R_1$ or $R_2$ is an unsubstituted alkyl group, an alkoxy group-substituted alkyl group, or a sulfoalkyl group.

4. The silver halide photographic material as in claim 1, wherein $R_3$ is an unsubstituted alkyl group or an unsubstituted aryl group.

5. The silver halide photographic material as in claim 1, wherein the substituent represented by $V_1$, $V_2$, $V_3$, $V_4$, $V_5$ or $V_6$ is a hydrogen atom, a halogen atom, an alkyl group, an acyl group, an acyloxy group, an alkoxycarbonyl group, a carbamoyl group, a sulfamoyl group, a carboxyl group, a cyano group, a hydroxyl group, an amino group, an acylamino group, an alkoxy group, an alkylthio group, an alkylsulfonyl group, a sulfonic acid group, or an aryl group.

6. A silver halide photographic material comprising a support having thereon at least one silver halide emulsion layer, wherein the layer contains at least one compound represented by formula (II):

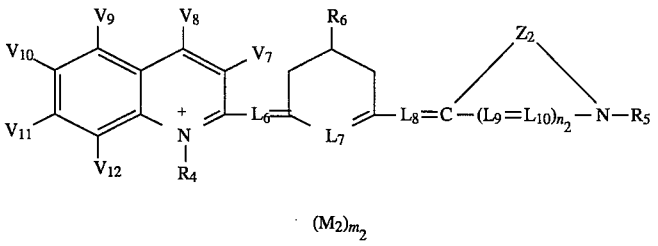

(II)

wherein $Z_2$ represents an atomic group required for forming a five-membered or six-membered nitrogen-containing heterocyclic ring;

$R_4$ and $R_5$ each represents an alkyl group;

$R_6$ represents an alkyl group, aryl group or a heterocyclic group;

$V_7$, $V_8$, $V_9$, $V_{10}$, $V_{11}$ and $V_{12}$ each represents a hydrogen atom or a substituent;

$L_6$, $L_7$, $L_8$, $L_9$ and $L_{10}$ each represents a methine group;

$n_2$ represents 0 or 1;

$M_2$ represents an ion for neutralizing charge; and $m_2$ represents number of 0 or more which is required for neutralizing charge in the compound.

7. The silver halide photographic material as in claim 6, wherein the heterocyclic ring formed by $Z_2$ is a benzthiazole, naphthothiazole, benzoxazole, or naphthoxazole nucleus.

8. The silver halide photographic material as in claim 6, wherein the alkyl group represented by $R_4$ or $R_5$ is an unsubstituted alkyl group, an alkoxy group-substituted alkyl group, or a sulfoalkyl group.

9. The silver halide photographic material as in claim 6, wherein $R_6$ is an unsubstituted alkyl group or an unsubstituted aryl group.

10. The silver halide photographic material as in claim 6, wherein the substituent represented by $V_7$, $V_8$, $V_9$, $V_{10}$, $V_{11}$ and $V_{12}$ is a hydrogen atom, a halogen atom, an group, alkyl group, an acyl group, an acyloxy group, an alkoxycarbonyl group, a carbamoyl group, a sulfamoyl group, a carboxyl group, a cyano group, a hydroxyl group, an amino group, an acylamino group, an alkoxy group, an alkylthio group, an alkylsulfonyl group, a sulfonic acid group, or an aryl group.

* * * * *